US008910554B2

(12) United States Patent
Kinugasa

(10) Patent No.: US 8,910,554 B2
(45) Date of Patent: Dec. 16, 2014

(54) PROTECTIVE SLEEVE FOR MOTOR COMPONENT AND METHOD FOR MANUFACTURING SAME

(75) Inventor: Atsushi Kinugasa, Hyogo (JP)

(73) Assignee: Gosen Co., Ltd., Osaka (JP)

( * ) Notice: Subject to any disclaimer, the term of this patent is extended or adjusted under 35 U.S.C. 154(b) by 86 days.

(21) Appl. No.: 13/813,871

(22) PCT Filed: Apr. 15, 2011

(86) PCT No.: PCT/JP2011/059355

§ 371 (c)(1), (2), (4) Date: Feb. 1, 2013

(87) PCT Pub. No.: WO2012/017714

PCT Pub. Date: Feb. 9, 2012

(65) Prior Publication Data

US 2013/0125739 A1 May 23, 2013

(30) Foreign Application Priority Data

Aug. 5, 2010 (JP) ..... 2010-176488

(51) Int. Cl.
*D04C 1/06* (2006.01)

(52) U.S. Cl.
CPC ..... *D04C 1/06* (2013.01)
USPC ..... 87/9

(58) Field of Classification Search
CPC ..... D04C 1/06; H02K 3/44
USPC ..... 87/1, 6, 9
See application file for complete search history.

(56) References Cited

U.S. PATENT DOCUMENTS

| | | | | |
|---|---|---|---|---|
| 5,092,727 | A * | 3/1992 | Moghe | 411/411 |
| 5,197,370 | A * | 3/1993 | Gladfelter | 87/7 |
| 5,866,216 | A * | 2/1999 | Flasher | 428/36.1 |
| 6,341,550 | B1 * | 1/2002 | White | 87/5 |
| 6,997,096 | B2 * | 2/2006 | Niwa | 87/9 |
| 7,074,470 | B2 | 7/2006 | Niwa | |
| 7,204,903 | B2 * | 4/2007 | Yasui | 156/149 |
| 7,566,376 | B2 * | 7/2009 | Matsuoka | 156/149 |
| 2004/0091655 | A1 * | 5/2004 | Niwa | 428/36.3 |
| 2004/0094023 | A1 * | 5/2004 | Niwa | 87/1 |
| 2005/0076995 | A1 * | 4/2005 | Yasui | 156/148 |

FOREIGN PATENT DOCUMENTS

| | | |
|---|---|---|
| JP | 10-273825 | 10/1998 |
| JP | 2001-123324 | 5/2001 |
| JP | 2004-176243 | 6/2004 |
| JP | 2007-63730 | 3/2007 |
| JP | 2009-68146 | 4/2009 |
| JP | 2009-235582 | 10/2009 |
| JP | 2010-150722 | 7/2010 |

* cited by examiner

*Primary Examiner* — Shaun R Hurley
(74) *Attorney, Agent, or Firm* — Hamre, Schumann, Mueller & Larson, P.C.

(57) ABSTRACT

The protective sleeve for a motor component of the present invention is obtained by braiding multifilament yarns made of synthetic fibers into a cylindrical braided cord of at least 24 strands. The multifilament yarns have a single-yarn fineness of at least 15 dtex but less than 30 dtex and the yarn total fineness of a single braid unit of the braided cord is in the range of 800 to 1500 dtex. This protective sleeve has good covering properties and few voids. Therefore, a protective sleeve for a motor component is provided that has high partial discharge characteristics (electrical insulation performance) and good electrical insulation properties even when a step of washing away the raw yarn oil solution applied to the filaments was omitted.

12 Claims, 3 Drawing Sheets

PROTECTIVE SLEEVE FOR MOTOR COMPONENT AND METHOD FOR MANUFACTURING SAME

TECHNICAL FIELD

The present invention relates to a protective sleeve for a motor component and a method for manufacturing the same. More specifically, the present invention relates to a protective sleeve for a motor component, which has a high fiber density and high electrical insulation properties, and a method for manufacturing the same.

BACKGROUND ART

Conventionally, there have been demands for achieving both a decrease in hazardous substances contained in the exhaust gas emitted from vehicles and an increase in gas mileage. In recent years, there have been further demands for reducing the load on the environment globally. Against this background, the development of electric vehicles has been promoted. Electric vehicles currently being developed or produced include, for example, a pure electric vehicle (PEV) equipped with a high capacity secondary battery, a hybrid electric vehicle (HEV) in which, for example, a gasoline engine and a high power secondary battery are combined, and further a fuel cell vehicle (FCV) in which, for example, a fuel cell and a high power secondary battery are combined. In any of these cases, the development of a high-efficiency motor is required. Such motors include driving motors, electricity generating motors, and electric charging motors. It also has been strongly demanded to stabilize the quality of the motors in terms of the running stability, in addition to an increase in efficiency. Especially, motors for electric vehicles are required to have excellent oil resistance at high temperatures as compared with motors for common vehicles. In order to improve the efficiency, motors for electric vehicles need to be in an ATF (automatic transmission fluid). Since the ATF may reach a high temperature, the motors are required to have resistance to high temperatures in the ATF.

Conventionally, it has been proposed to use multifilament yarns of polyphenylene sulfide (PPS) fibers as an electrical insulating material (Patent Document 1). Furthermore, it also has been proposed to use monofilament yarns of PPS fibers to produce a protective sleeve (see Patent Document 2). Moreover, for electric vehicles, a cylindrical flexible protective sleeve has been proposed that is produced by using both monofilaments and multifilaments with oil resistance at high temperatures (see Patent Document 3). A protective sleeve also has been proposed that has a cylindrical braided cord structure made of 4 to 50 filament yarns with a single-yarn fineness of 30 to 100 dtex (see Patent Document 4). Furthermore, a protective sleeve also has been proposed that has a cylindrical braided cord structure made of 4 to 30 filament yarns with a single-yarn fineness of 19 to 88 dtex (see Patent Document 5).

When a sleeve is produced using multifilaments of ordinary thickness with a single-yarn fineness of around 5 dtex, it cannot maintain its cylindrical shape and is deformed into a squashed flat shape. This results in difficulties to insert a copper wire into the sleeve, which has been a problem. Patent Document 2 mentioned above proposes a sleeve that is produced using monofilaments. In this case, the sleeve has a cylindrical shape but using the monofilaments alone results in a rough braided structure and thus voids due to their thick fibers. This results in poor electrical insulation properties, which has been a problem. In Patent Document 3, the present applicant proposed the use of both monofilaments and multifilaments. In this case, a sleeve with excellent workability, adequate flexibility, and good copper wire covering properties can be obtained. However, since two types of yarns that are greatly different in thickness of their single yarns from each other are braided, processing stability is an issue, including tautening. Furthermore, there is a problem that multifilaments whose fibers are thinner tend to be napped. Patent Documents 4 and 5 propose braided cords that maintain cylindrical shapes using multifilaments with higher single-yarn fineness.

On the other hand, motor and automobile manufacturers have been requesting a further improvement in electrical insulation performance of sleeves, but at the same time, there have also been demands for increasing the economic efficiency and reducing the weight and size of components.

PRIOR ART DOCUMENTS

Patent Documents

Patent Document 1: JP 10-273825 A
Patent Document 2: JP 2001-123324A
Patent Document 3: JP 2004-176243A
Patent Document 4: JP 2007-63730 A
Patent Document 5: JP 2009-235582 A

DISCLOSURE OF INVENTION

Problem to be Solved by the Invention

In order to solve the conventional problems described above, the present invention provides a protective sleeve for a motor component, which has excellent partial discharge characteristics, i.e., high electrical insulation performance, and good electrical insulation properties even when a step for washing away the raw yarn oil solution applied to filaments is omitted, and a method for manufacturing the same.

Means for Solving Problem

The protective sleeve for a motor component of the present invention is obtained by braiding multifilament yarns made of synthetic fibers into a cylindrical braided cord of at least 24 strands, wherein the multifilament yarns have a single-yarn fineness of at least 15 dtex but less than 30 dtex and the yarn total fineness of a single braid unit of the braided cord is in the range of 800 to 1500 dtex.

The method for manufacturing a protective sleeve for a motor component of the present invention is characterized by obtaining a cylindrical sleeve by braiding multifilament yarns, with an at least 24-strand braiding machine, along the outer periphery of a circular or polygonal round rod with a tip whose size is substantially equivalent to the inner diameter of a braided cord, with a lift head being moved vertically up and down from the bottom of the center. The multifilament yarns have a single-yarn fineness of at least 15 dtex but less than 30 dtex and a yarn total fineness of a spool-wound single braid unit of 800 to 1500 dtex.

Effects of the Invention

The protective sleeve for a motor component of the present invention has flexibility and a cylindrical shape. It has adequate elasticity, which is exhibited when being pressed down. It has excellent insertability for a component such as a coil. It has higher partial discharge characteristics (electrical insulation performance) as compared to conventional sleeves. It has good electrical insulation properties even when a step of washing away the raw yarn oil solution applied to the filaments is omitted. Moreover, a protective sleeve for a motor component can be obtained, in which when the sleeve surface has very few openings (voids) and the sleeve has an adequate thickness (wall thickness), the increase in amount of material fibers to be used can be minimized and a high electrical insulation performance can be obtained without washing away the oil solution applied to the raw yarns.

BRIEF DESCRIPTION OF DRAWINGS

FIG. 1 is a traced drawing of a side surface of a protective sleeve for a motor component according to an example of the present invention, with the side surface being observed with a light microscope (at 50 times power).

FIG. 2 is a traced drawing of a side surface of a protective sleeve for a motor component according to Comparative Example 4, with the side surface being observed with a light microscope (at 50 times power).

FIG. 3 is a schematic drawing for explaining the method of producing multifilament interlaced yarns, which are used in an example of the present invention, and the structure thereof.

[FIG. 4]

DESCRIPTION OF THE INVENTION

Figure 1:
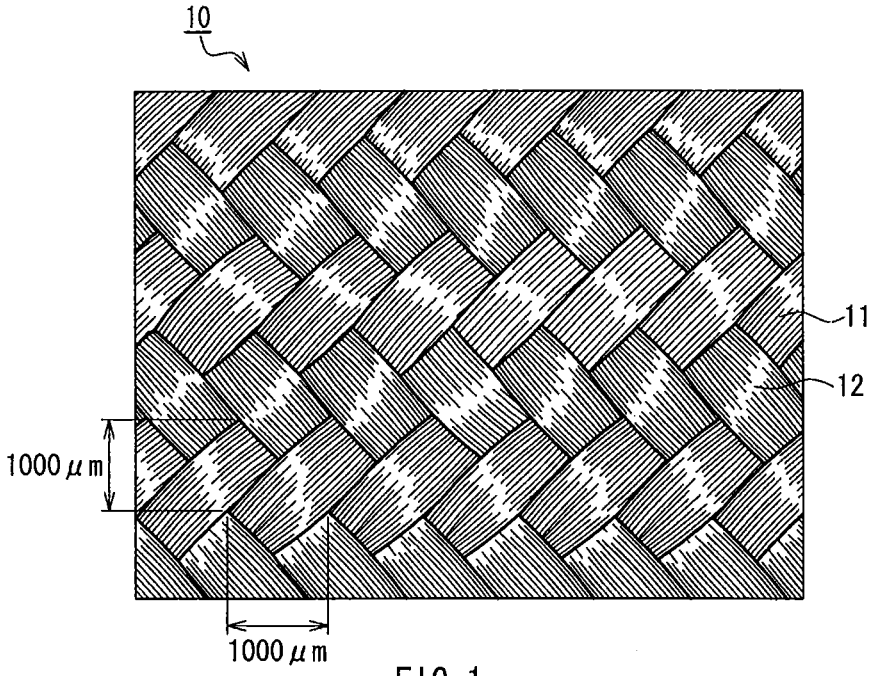
[FIG. 1]

The present inventor ardently studied about improving the electrical insulation performance while maintaining workability. As a result, it has been found that when the single-yarn fineness is in a particular range, the surface of the protective sleeve for a motor component (hereinafter referred to also as a "sleeve") has very few openings (voids), and it has an adequate thickness (wall thickness), it is possible to minimize the increase in the amount of material fibers to be used and to obtain a high electrical insulation performance without washing away the oil solution applied to the raw yarns. These findings have lead to the present invention.

The protective sleeve of the present invention is used as a motor component, for example, a coil, a wire, or a binding band. The protective sleeve of the present invention is a cylindrical sleeve for covering and protecting a motor component such as an enameled wire and is used for protecting a coil. Examples of the motor include a motor for a vehicle, a motor for an electrical home appliance such as an air-conditioner or a refrigerator, and a power motor, and the motor for a vehicle is preferable. Examples of the motor for a vehicle include a motor for an electric vehicle, a motor for a gasoline-powered vehicle, and a motor for a diesel-powered vehicle, and the motor for an electric vehicle is preferable.

The protective sleeve of the present invention is a cylindrical braided cord of at least 24 strands obtained by braiding multifilament yarns made of synthetic fibers. The number of strands (the number of bobbins used for braiding the braided cord) of a braider is generally 24, 32, 40, 48, 56, 64, 72, 80, 88, or 96. Among these, 32 (a diameter of approximately 4 mm), 48 (a diameter of approximately 6 mm), 56 (a diameter of approximately 7 mm), and 64 (a diameter of approximately 8 mm) are practical for a protective sleeve for a motor component for a vehicle. However, since there also are smaller or larger motors for uses other than vehicles, the number of strands of a braided cord needs to be at least 24. Preferable numbers of strands of the braider are 32 to 64.

The fibers constituting the sleeve of the present invention are multifilament yarns with a higher single-yarn fineness than usual and the single-yarn fineness is at least 15 dtex but less than 30 dtex. Since a single-yarn fineness of less than 15 dtex results in thin and soft fibers, a stable cylindrical-shaped sleeve cannot be obtained and the sleeve has a flat shape. Thus it does not permit sufficient insertability of a component. On the other hand, when the single-yarn fineness is 30 dtex or higher, the sleeve has a cylindrical shape and high stability but has problems in terms of the partial discharge performance and filament production. In other words, in terms of industrial production, a monofilament spinning machine or a multifilament spinning machine is used for producing filaments whose single yarn is approximately 30 dtex to 100 dtex. Generally, in the case of a single-yarn fineness of at least approximately 50 dtex, a monofilament spinning machine that cools melted and discharged yarns with water is more suitable, but yarns with a single-yarn fineness of less than approximately 50 dtex fall into a thinner range than an adequate range for the monofilament spinning machine. This results in a decrease in discharge rate and thereby tends to cause a deterioration in productivity, unevenness in yarn fineness, broken yarn, etc., which are problems. On the other hand, the multifilament spinning machine generally has a high spinning speed and high productivity but employs an air cooling system that cools yarns with cold air, which generally results in insufficient cooling in the case of 30 dtex or more. Furthermore, it causes insufficient heating during drawing and therefore the spinning and drawing speeds have to be reduced further, which results in problems that not only the productivity deteriorates but also broken yarns and unevenness in yarn fineness tend to occur. More particularly, in the case of a thickness of 30 to 100 dtex, particularly 30 to 50 dtex, both the monofilament spinning machine and the multifilament spinning machine have problems of quality instability and high production cost.

The single-yarn fineness of the present invention is at least 15 dtex but less than 30 dtex. In this range, there is an advantage that the multifilament spinning machine can achieve approximately the same level of productivity as that obtained by general spinning of yarns with a single-yarn fineness of less than 10 dtex. The preferable single-yarn fineness is 16 to 25 dtex. In this range, it is possible to increase the productivity and to reduce the cost.

Figure 2:
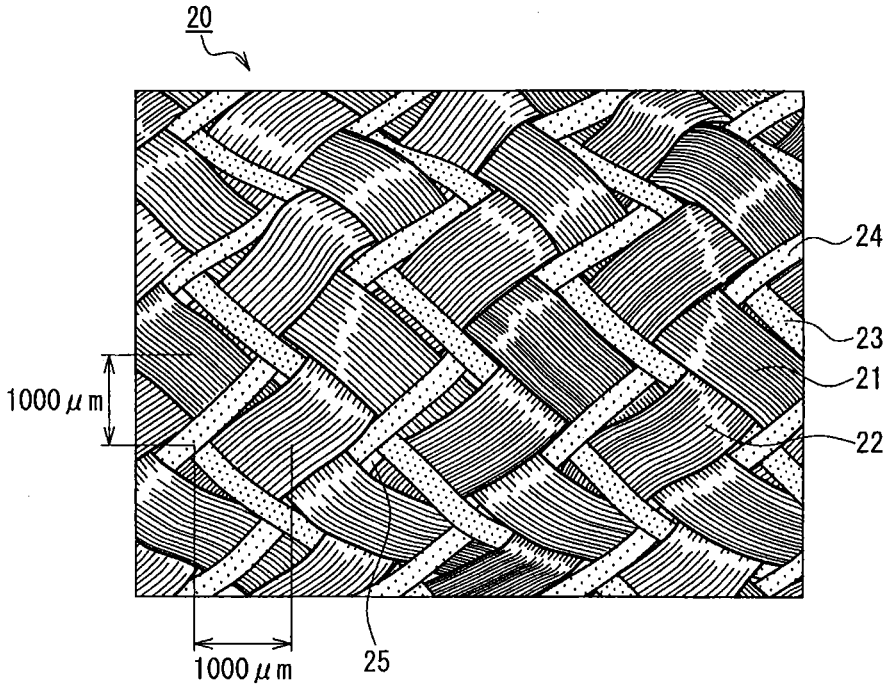
FIG. 2 PRIOR ART
[FIG. 2]

Furthermore, according to the study made by the present inventor, the covering properties and thickness of the sleeve are important in order to improve the partial discharge characteristics. "Good covering properties" denote a state where the whole sleeve surface is covered with fibers and there are very few voids and gaps, for example, the state shown in FIG. 1. In contrast, when there are openings (voids) that are not covered with fibers as shown in FIG. 2, the discharge characteristics deteriorate. Whether the openings (voids) are present or absent is determined through observation with a light microscope at 50 times power.

With respect to the thickness (wall thickness) of the sleeve, when it is thin, the electrical insulation properties are not sufficient while an excessively thick sleeve results not only in a higher cost due to an increase in the amount of fibers to be used but also in an increase in weight and volume of the sleeve. This is contrary to the demands for reducing the size and weight of motors and therefore is not preferable. The thickness of the sleeve of the present invention is preferably 0.35 mm to 0.55 mm, more preferably 0.38 mm to 0.50 mm.

The present inventor has found that in order to satisfy both the thickness and the covering properties, when filaments with a single-yarn fineness of at least 15 dtex but less than 30 dtex are used as braiding yarns with a total fineness of 800 to 1500 dtex to be braided and wound around a spool and are braided into a cylindrical shape with at least 24 strands, a sleeve that maintains the cylindrical shape thereof and has an improved electrical insulation performance can be obtained and it also is excellent in terms of light weight, small size, and economical efficiency. The preferable single-yarn fineness is 16 to 25 dtex, and preferable total fineness is 850 to 1450 dtex. This range allows the sleeve further to maintain the cylindrical shape thereof, to have improved electrical insulation performance, and also to be excellent in terms of light weight, small size, and economical efficiency.

When the total fineness is less than 800 dtex, the sleeve has a reduced wall thickness and deteriorated discharge characteristics. On the other hand, when it exceeds 1500 dtex, the sleeve has an increased wall thickness and has problems in terms of light weight, small size, and low cost.

In order to obtain the total fineness in the range mentioned above, it also is possible to parallel and double a plurality of yarns. The number of the filaments of the multifilament yarns thus doubled is preferably 27 to 100, more preferably 36 to 60.

In the present invention, the sleeve has preferably a thickness (wall thickness) of 0.35 to 0.55 mm, more preferably 0.38 to 0.50 mm. The wall thickness in these ranges can be obtained comparatively easily by using yarns with the above-mentioned total fineness and employing appropriate braiding conditions.

The fiber material to be used for the protective sleeve is not particularly limited, but a material with heat resistance and oil resistance at high temperatures is used preferably. With respect to the heat resistance, the melting point is at least 270° C., preferably at least 280° C. Particularly, polyphenylene sulfide (PPS) fibers or aramid fibers are used preferably. The aramid fibers include a p-aramid fiber and an m-aramid fiber. However, the m-aramid fiber with a higher fiber elongation is used preferably. In addition, heat resistant fibers made of, for example, polyether ether ketone (PEEK), polyetherimide, and semiaromatic polyamides such as nylon 9T and 6T also can be used if the oil resistance at high temperatures thereof satisfies the conditions of the present invention.

The sleeve of the present invention preferably has oil resistance at high temperatures. In this specification, the oil resistance at high temperatures denotes that the value determined by the following method is at least 50%.

$$\text{Oil resistance at high temperatures}(\%)=(T/T)\times 100$$

In the above formula, T denotes the tensile strength of the protective sleeve before treatment and T denotes the tensile strength of the protective sleeve after the treatment.

The tensile strength is that specified in JIS L1013-8.5.1.

The treatment mentioned above is a treatment in which the whole protective sleeve is placed in a mixture of 0.5 wt % of water and 99.5 wt % of automatic transmission fluid in an airtight container and the container is then heated so that the temperature of the mixture in the container is maintained at 150° C. for 1000 hours.

The oil resistance at high temperatures is most influenced by the material for the sleeve but it is also influenced by the thickness of a single fiber and the fiber fine structure. Since the oil that is used for evaluating the oil resistance at high temperatures in the present invention contains a small amount of water, it also indicates that the hydrolysis resistance is high.

The oil resistance at high temperatures is preferably at least 70%, more preferably at least 80%, and further preferably at least 85%. This is because, for example, in electric vehicles, the oil resistance at high temperatures in such ranges makes it possible to obtain motors that can operate stably over a longer period of time.

The sleeve of the present invention has improved electrical insulation properties as compared to conventional ones. In the present invention, the electrical insulation performance (partial discharge performance) of the sleeve is indicated by partial discharge inception voltage (V) obtained by the following measurement method.

Sample Preparation: A sleeve was cut into a length of approximately 100 mm and then as a pretreatment, it was left for 24 hours in an environment (a constant temperature and humidity bath) with a temperature of 40° C. and a relative humidity of 90% RH, which was set assuming a high humidity environment condition.

Measuring Instrument Partial Discharge Detector (TYPE B009), manufactured by Mitsubishi Cable Industries, Ltd.

Measurement: Samples left under high humidity were taken out one by one to be measured immediately thereafter.

A coil wire bundle to serve as an electrode B was inserted into the sleeve. A pressure of 1N was applied to a brass circular disc to serve as an electrode A from the outside of the sleeve, and was stepped up every 100 V between A and B, i.e. between the inside and the outside of the sleeve. The maximum applied voltage where the discharge charge amount was 0 Pc (picocoulomb) was taken as the partial discharge inception voltage. The measurement result is indicated with the average of five measurements.

Conventionally, the partial discharge voltage was approximately 1300 V after washing and around 1000 V before washing (for example, Patent Document 5 described above). However, the sleeve of the present invention has electrical insulation properties of preferably at least 1700 V, more preferably at least 1750 V when measured immediately after being left under high humidity (without washing). The higher the electrical insulation properties, the more preferable.

In order to improve the electrical insulation properties, it is also effective to remove the oil solution applied to the raw yarns by washing, but since the sleeve is flexible and tends to be deformed under tension, washing is problematic in terms of cost and handling of the sleeve. Therefore, there are demands for sleeves that have high electrical insulation performance even when a washing step is omitted and they contain a raw yarn oil solution.

As described above, in terms of the heat resistance, oil resistance at high temperatures, and electrical insulation properties under high humidity, the most preferred material as the sleeve material of the present invention is polyphenylene sulfide (PPS). Polyamides having an amide group absorb moisture under high humidity and thereby deteriorate the electrical insulation properties. Therefore, PPS is used more preferably.

Next, the sleeve of the present invention is characterized by having good covering properties and no voids (openings) observed at the sleeve surface. When thick monofilaments were used as in Patent Document 3 described above, the yarns were hard and therefore no tight braided stitches were obtained even by a lifting operation for braiding, and lots of voids were observed, with a stereomicroscope, especially in the vicinity of interlaced points of the monofilaments. These voids are considered to cause lower discharge inception voltage in spite of the thickness that is equal to or more than that of the present invention. On the other hand, it was found that even when the single-yarn fineness was high, particularly, at least 30 dtex, the electrical insulation properties were not sufficient with respect to the thickness as compared to the present invention. It is assumed that the high single-yarn fineness increased the flexural rigidity as a whole filament, which tended to result in gaps in the vicinity of braided stitches of the filaments, and this caused a deterioration in electrical insulation properties.

The following description will be made with reference to the drawings. FIG. 1 is a traced drawing of a side surface of a protective sleeve for a motor component according to an example of the present invention, with the side surface being observed with a light microscope (at 50 times power). A sleeve 10 is braided with, for example, multifilament braiding yarns 11, 12, but no openings (voids) are observed at the surface thereof. That is, braided stitches of the multifilament braiding yarns 11, 12 are dense and tight and therefore no gaps are observed.

On the other hand, Comparative Example 4 (a conventional art using both monofilaments and multifilaments) shown in FIG. 2 has openings (voids) 25 present at the intersections a for example, the multifilament braiding yarns 21, 22 and the monofilament braiding yarns 23, 24 that compose a sleeve 20. This state results in insufficient electrical insulation properties.

Preferably, the multifilament yarns that are used in the present invention have been interlaced. Interlacing is carried out by treating the multifilament yarns with an air interlacer to interlace constituent fibers of the multifilament yarns with each other. Interlacing allows the multifilament yarns to have improved bundling properties (coherence), and thereby they are prevented from being separated and thus have improved processability and handling properties. In addition, due to tension, friction, etc. applied to interlaced yarns when they are braided into a braided cord, interlaced parts thereof tend to come loose. This tends to cause the constituent yarns of the sleeve braided into a braided cord to be flattened as a whole, which also contributes to eliminating voids. This presents a synergistic effect with the selection of the single-yarn fineness and total fineness of the multifilament yarns within particular ranges. In the case of an untwisted yarn, it has poor bundling properties and therefore tends to be napped or broken while being wound around a spool or being braided. In the case of a twisted yarn, it has good bundling properties but has a round cross section and thereby tends to cause voids, which is not preferable.

Figure 3:
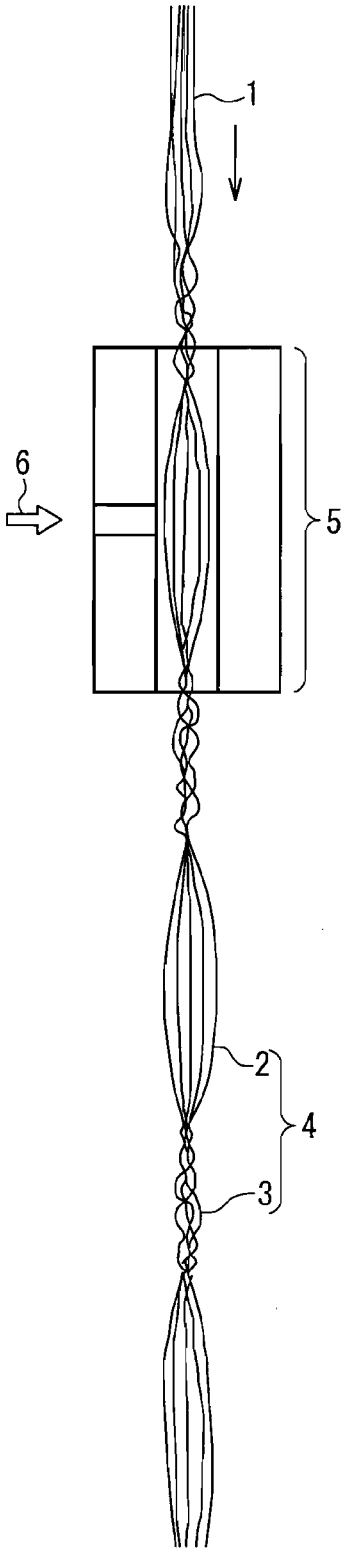
[FIG. 3]

FIG. 3 is a schematic drawing for explaining the method of producing multifilament interlaced yarns, which are used in an example of the present invention, and the structure thereof. Synthetic fiber multifilament feeding yarns 1 are fed into a fluid interlacer 5 and pressure air 6 is fed thereinto to form an opened part 2 and a bundled part 3. Thus an interlaced yarn 4 is obtained. Since the bundled part 3 is formed at each end of the opened part 2, the opened portions are present intermittently in terms of the opened part 2. Preferably, the number of interlaced portions of the bundled parts 3 is in the range of 5 to 20 per meter. The method of determining the degree of interlace is as follows: filament yarns are allowed to float on water and then the number of interlaced portions is determined.

For the protective sleeve of the present invention, filament yarns with a single-yarn fineness of at least 15 dtex but less than 30 dtex are wound around a spool in such a manner as to have a total fineness of 800 to 1500 dtex. One multifilament may be used to be wound around a spool or a plurality of multifilaments may be doubled and then be wound around a spool. Preferably, using this spool, the multifilaments are braided while being lifted with an at least 24-strand braiding machine.

Changing the strand number can change mainly the thickness (inner diameter and outer diameter) of the sleeve. The strand number to be used preferably is 24 to 96. A cord being braided in a braiding step is braided while a circular or polygonal, metal or wooden, and round rod with a tip whose size is substantially equivalent to the inner diameter of the cord is moved (lifted) vertically up and down from the bottom at the center of the braiding machine. Thus a cylindrical sleeve can be obtained.

When a cord is braided using filaments having a single-yarn fineness and a total fineness of the present invention and it is taken out at a lower tension, a sleeve having tight braided stitches and good covering properties can be obtained. When it is taken out with tension, caution should be exercised since the sleeve is stretched to have a smaller inner diameter, or in some cases, to have braided stitches misaligned, which results in a deterioration in discharge characteristics. Furthermore, the yarns whose single-yarn fineness is higher than that of the present invention are hard. This causes insufficiently tight braided stitches even through the lifting operation, and thus void parts tend to be formed. This then tends to cause variations and a deterioration in discharge characteristics, which is not preferable. The number of braided stitches is preferably 20 to 40 stitches/inch (25.4 mm), more preferably 23 to 36 stitches/inch (25.4 mm). Furthermore, a preferable weight per unit length of the sleeve is 4 g/m to 12 g/m.

During the stage between lifting and taking out, it is possible to use a heater to carry out a heat treatment and thereby to stabilize the shape as required. For example, in the case of PPS, it is possible to stabilize the shape by carrying out a heat treatment at an atmospheric temperature of 160 to 290° C. for 0.2 to 5 minutes without any contact with the heater. It was found that when the conditions of the present invention were satisfied, the sleeve was able to have high electrical insulation properties with a partial discharge inception voltage of at least 1700 V even when the sleeve contained an oil solution. A preferable amount of the oil is 0.3 to 2.0 wt %. Naturally, when the sleeve is washed and the oil solution was removed as required, the electrical insulation performance further improves.

The filament raw yarns that are typically used have an oil solution applied for improving the processability in the raw yarn production process and the higher-order processing including, for example, twisting, weaving, and braiding. The components of the oil solution include those that deteriorate electrical insulation properties, such as an antistatic agent and an emulsifier. However, when these components are eliminated, yarns would be napped or broken frequently during the production process and processing steps. Therefore, it is difficult perfectly to prevent the deterioration in electrical insulation while preventing the deterioration in processability with the components of the oil solution. On the other hand, the protective sleeve of the present invention is characterized by exhibiting sufficiently high electrical insulation properties even when containing an ordinary raw yarn oil solution.

The protective sleeve for a motor component of the present invention varies depending on the type of the motor and component for which it is used and is not particularly limited. Generally, however, for example, one with an inner diameter of 3 to 9 mm is used. A further preferable inner diameter is 3 to 8 mm. With respect to the length, it can be cut into a required length at any stage, and it is usually approximately 3 to 50 cm. When being used for an electric vehicle, the protective sleeve has, for example, an inner diameter of approximately 3 to 8 mm and a length of approximately 3 to 50 cm.

Furthermore, a long sleeve may be cut into a required length at the motor component production site to be incorporated into a component.

Preferably, the protective sleeve is eventually varnished. This is because when it is varnished, the protective sleeve can have enhanced electrical insulation properties and improved resistance to various mechanical stresses. Varnishing can be carried out after or before a motor component to be protected is inserted into a protective sleeve but it is more preferable to carry it out after insertion. This is because the work efficiency in the inserting process is higher. Varnishing can be carried out by, for example, inserting a motor component into a protective sleeve, then applying varnish to the protective sleeve by impregnation, spraying, dripping, or by using a brush, and drying it to be cured. The sleeve of the present invention maintains its cylindrical shape and is not flattened. Moreover, the sleeve also is characterized by adapting to the shape of a coil wire after it is inserted.

Figure 4A:
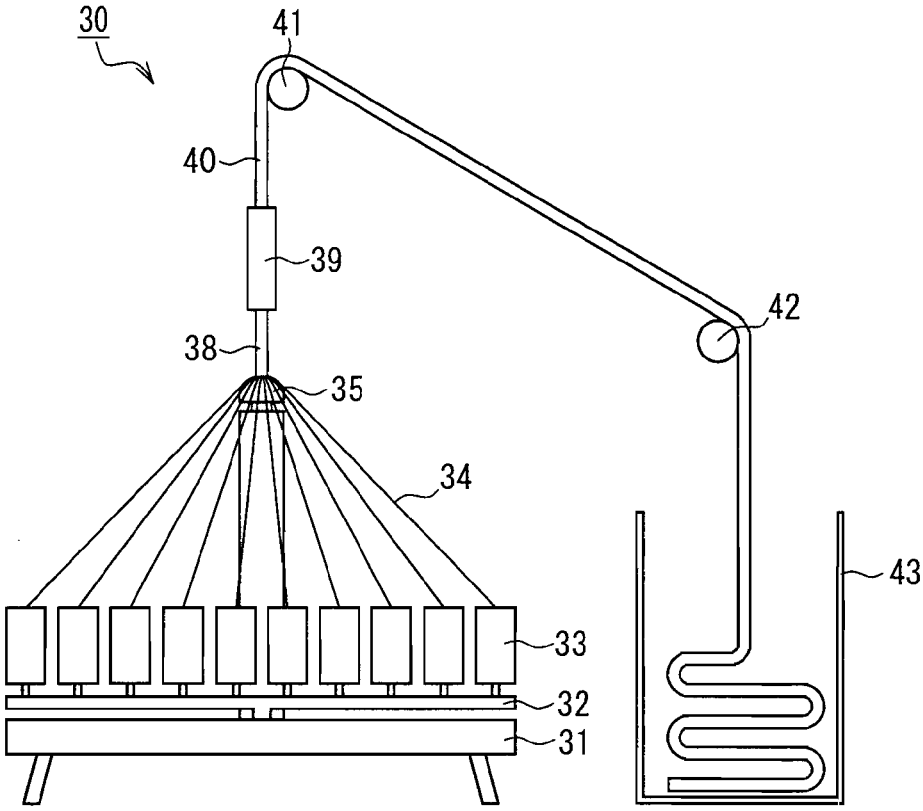
FIG. 4A is a schematic drawing for explaining an equipment for manufacturing a braided sleeve according to an example of the present invention and FIG. 4B is a drawing for explaining the main part thereof.
Figure 4B:
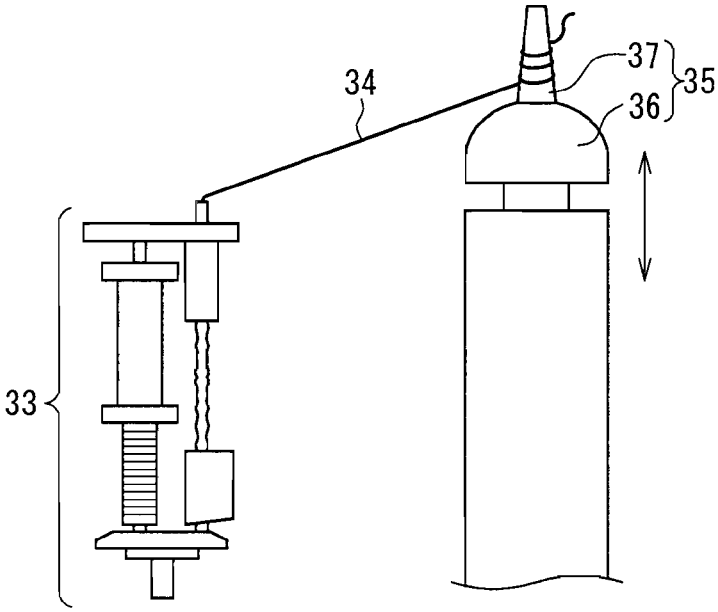

FIG. 4A is a schematic drawing for explaining an equipment for manufacturing a braided sleeve according to an example of the present invention and FIG. 4B is a drawing for explaining the main part thereof. This manufacturing equipment 30 includes platforms (31, 32), bobbins 33, a lifting part 35, and a drive (not shown). Rotational movement of the bobbins 33 allows yarns 34 wound around the bobbins 33 to be braided on the circumference of a cylindrical part 37 of the lifting part 35, and thereby a braided sleeve 38 is produced. The lifting part 35 includes a hemispherical head 36 that moves up and down in conjunction with the rotational movement of the bobbins 33, and the cylindrical part 37 with a cylindrical shape (or a polygonal shape) located in the center of the hemispherical head 36. The outer diameter of the cylindrical part 37 is substantially equal to the inner diameter of the braided sleeve 38. The braided sleeve 38 is then fed to a heater 39 to be heat set. The braided sleeve 40 thus heat set passes through drawing guides (pulleys) 41, 42 to be thrown off into a container 43. In the above description, the stroke length and the number of strokes of the lifting part 35 can be set suitably. Furthermore, the heat set may be carried out in a continuous process or in another process.

EXAMPLES

Hereinafter, the present invention is described in further detail using examples and comparative examples but is not limited to the following examples.

In the following examples and comparative examples, various measurements were carried out as follows.

(1) Oil Resistance at High Temperatures

The whole protective sleeve with a length of 60 cm was placed in a mixture (5 liters) of 0.5 wt % of water and 99.5 wt % of automatic transmission fluid (ATFWS (trade name), manufactured by Esso Sekiyu K.K.) in an airtight container, and the container was then heated so that the temperature of the mixture in the container was maintained at 150° C. for 1000 hours. The tensile strength (T) of the protective sleeve before this treatment and the tensile strength (T) of the protective sleeve after the treatment were measured in accordance with JIS L1013-8.5.1. Each of the tensile strengths thus obtained was introduced into the following formula and thereby the oil resistance at high temperatures was obtained. The average of the values obtained from five measurements was calculated.

$$\text{Oil resistance at high temperatures}(\%)=(T/T)\times 100$$

In this formula, T denotes the tensile strength of the protective sleeve before the treatment and T denotes the tensile strength of the protective sleeve after the treatment.

(2) Inner Diameter, Thickness (Wall Thickness), Number of Braided Stitches

Inner Diameter: A conical taper gauge (a measuring instrument: a taper gauge 710B (4 to 15 mm) manufactured by Niigata Seiki Co., Ltd.) was made to stand with its taper tip facing upward and the sleeve was placed lightly thereon with the taper tip being inserted thereinto. Then the gauge on the edge face of the sleeve was read out. Braided Stitches (stitches/inch): While a magnifier (linen tester) having a frame whose one side is one inch was allowed to be in light contact with a side surface of the sleeve to an extent that does not deform the sleeve, the number of the braided stitches in one inch was measured within 0.5 stitches. Thickness (Wall Thickness): A caliper was used to measure the thickness (mm) by sandwiching the sleeve by the inner side and the outer side thereof. The measurement was carried out three times and the average thereof was calculated in each case.

(3) Weight Per 1 m of Sleeve (g/m)

A sleeve left in a standard condition (at a temperature of 20±3° C. and a relative humidity of 65±3%) for 24 hours was cut into a length of 50 cm. The weight thereof was measured and the weight per 1 m of the protective sleeve was then calculated.

(4) Partial Discharge Characteristics (a) Sample Preparation: A sleeve was cut into a length of approximately 100 mm and then as a pretreatment, it was left for 24 hours in an environment (a constant temperature and humidity bath) with a temperature of 40° C. and a relative humidity of 90% RH, which was set assuming a high humidity environment condition.

(b) Measuring Instrument: Partial Discharge Detector (TYPE B009), manufactured by Mitsubishi Cable Industries, Ltd.

(c) Measurement: Samples left under high humidity were taken out one by one to be measured immediately thereafter.

(d) A coil wire bundle to serve as an electrode B was inserted into the sleeve. A pressure of 1N was applied to a brass circular disc (with a diameter of 25 mm and a thickness of 20 mm) to serve as an electrode A from the outside of the sleeve, and was stepped up every 100 V between A and B, i.e. between the inside and the outside of the sleeve. The pressure rising rate was approximately 0.2 second per 100V. The maximum applied voltage where the discharge charge amount was 0 Pc (picocoulomb) was taken as the partial discharge inception voltage. The measurement result was indicated with the average of five measurements.

(e) The partial discharge inception voltage (V) was measured by a unit of 100 V by the method described above. A discharge inception voltage of 1000 V denotes that the amount of discharge is 0 Pc up to 1000 V but exceeds 0 at 1100 V.

(f) The environment of the measuring room was 23±2° C. and 50±5% RH. In the case of "with washing", a reel of the protective sleeve was put into a washing bag and rinsed three times with an automatic washing machine (ASW-E10ZA, manufactured by Sanyo) to be washed for a total of 30 minutes and then it was spin-dried. Thereafter, it was dried at a room temperature. The measurement sample was used after being cut into a length of approximately 100 mm. In the case of "without washing", a braided product was used after being cut without being subjected to any further processes.

(5) Oil

Oil was extracted using methyl alcohol in accordance with JISL 1013 (1999)8.27c).

(6) Cylindrical Shape Retentive Properties

A sleeve was held between a thumb and an index finger and was subjected to an operation of compression and recovery repeated several times, and thereby the retentive and restorative properties and conformability (adaptability) of the shape were evaluated.

A: Having adequate restorative properties and adaptability.

B: Having good restorative properties but insufficient adaptability due to slight hardness (7) Covering Properties As shown in FIGS. 1 and 2, the side surface of the sleeve was observed with a light microscope and the covering properties were determined by the presence or absence of voids. In this case, the "voids" denote gaps, through which the inside of the sleeve can be seen and each of which is observed between a braiding yarn (multifilament) and a braiding yarn (multifilament) in, for example, the vicinity of an intersection between the braiding yarns when the side surface of the sleeve was observed with the microscope at 50 times power. The determination was made, with A denoting that the number of the voids per 100 square millimeters was 0 to 0.5 and B denoting that the number exceeded it.

(8) Number of Interlaced Portions of Multifilament

The number of interlaced portions with a length of at least 1 mm was determined by the water immersion method, which was then converted into the number per 1 m. Ten multifilament yarns were measured and the average thereof was indicated.

Examples 1 to 7 and Comparative Examples 1 to 5

PPS fibers (multifilament yarns), "TORCON" (trade name) manufactured by Toray Industries, Inc., with a melting point of 285° C. were made to have the single-yarn fineness and the total fineness as shown in Tables 1 and 2 and were braided by a lifting method using a 56-strand braiding machine shown in FIG. 4. In the below, 'T' and "F" of raw yarns denote the total fineness (unit: dtex) and the number of constituent filaments, respectively. All the raw yarns were air-interlaced by the method shown in FIG. 3. The yarn speed was 2200 m/min and the supply air pressure was 0.4 MPa.

Example 1

Two raw yarns 500T-20F (a single yarn: 25 dtex, the number of interlaced portions: 11/m) were doubled;

Example 2

Two raw yarns 440T-18F (a single yarn: 24.4 dtex, the number of interlaced portions: 10/m) were doubled;

Example 3

Two raw yarns 470T-20F (a single yarn: 23.5 dtex, the number of interlaced portions: 9/m) were doubled;

Example 4

Two raw yarns 550T-25F (a single yarn: 22 dtex, the number of interlaced portions: 11/m) were doubled;

Example 5

Four raw yarns 2207-10F (a single yarn: 22 dtex, the number of interlaced portions: 9/m) were doubled;

Example 6

Six raw yarns 167T-10F (a single yarn: 16.7 dtex, the number of interlaced portions: 10/m) were doubled;

Example 7

Three raw yarns 470T-20F (a single yarn: 23.5 dtex, the number of interlaced portions: 10/m) were doubled.

Except for Example 6, the oil solution contained the same components. With respect to the raw yarns of Examples 1 to 4, the amount of oil applied thereto was less than the common amount (approximately 0.8 wt %) in a range that does not hinder the braidability.

The sleeve characteristics and discharge characteristics are indicated together in Table 2. The sleeves of the examples of the present invention had cylindrical shape retentive properties (flexibility, adequate resilience and adaptability) and good covering properties and exhibited excellent electrical insulation properties, with a discharge inception voltage of at least 1700 V. FIG. 1 shows the absence of openings (voids) at the side surface of the protective sleeve for a motor component of Example 1 by a light microscope (at 50 times power).

Comparative Example 1

Using the same raw yarns as those used in Example 5, two raw yarns were doubled to be braided, with a total fineness of 440T. Lifting the sleeve allowed the braided stitches to be tightened to provide almost good covering properties but the thickness was not sufficient, which resulted in insufficient discharge characteristics.

Comparative Example 2

Using the same raw yarns as those used in Example 1, one raw yarn was used to be braided. As in Comparative Example 1, lifting allowed the braided stitches to be tightened (the number of braided stitches increased) but the thickness was not sufficient, which resulted in insufficient discharge characteristics.

Comparative Example 3

Using the same raw yarns as those used in Example 6, the number of the raw yarns to be doubled was reduced from six to four and they were braided, with a total fineness of 670 dtex. The thickness thereof increased as compared to those in Comparative Examples 1 and 2 but the discharge characteristics were not sufficient.

Comparative Example 4

Twenty eight each of monofilaments with a single-yarn fineness of 640 dtex (with a diameter of 0.25 mm) and common multifilaments with a single yarn of 4.4 dtex were wound around a spool, which were then set one by one to be braided. However, partial discharge characteristics were not sufficient. This shows that since monofilaments with a high fineness were used, the number of braided stitches was not able to be increased and thereby they were not able to be braided with the fibers being spread uniformly. Similarly in the microscopic picture shown in FIG. 2, voids were observed in the vicinity of intersections of the monofilaments. Reference numeral 25 denotes a void.

Comparative Example 5

Two filaments of 440T-12F (a single yarn: 36 dtex) single-twist 60 T/m were doubled to be braided. Since the single-yarn fineness was high and the bundling properties were poor, twisted yarns were used. Although the thickness was high, the discharge characteristics were not sufficient. It is presumed that since the single-yarn fineness was high and the yarns had to be twisted, there were gaps between the filaments and between the yarns, which resulted in insufficient discharge characteristics.

The above results were indicated together in Table 1 and 2.

TABLE 1

| | | | Braiding | | | | | |
|---|---|---|---|---|---|---|---|---|
| | Raw Yarns | Oil (wt %) | Braiding | Braid-ability | Single-Yarn Fineness (dtex) | Number of Filaments | Total Fineness (dtex) | With or Without Washing |
| Ex. 1 | 500T-20F | 0.4 | 2 yarns, 56 strands | A | 25 | 40 | 1000 | Without |
| | | | | | | | | With |
| Ex. 2 | 440T-18F | 0.4 | 2 yarns, 56 strands | A | 24.4 | 36 | 880 | Without |
| Ex. 3 | 470T-20F | 0.5 | 2 yarns, 56 strands | A | 23.5 | 40 | 940 | Without |
| Ex. 4 | 550T-25F | 0.5 | 2 yarns, 56 strands | A | 22 | 50 | 1100 | Without |
| Ex. 5 | 220T-10F | 0.8 | 4 yarns, 56 strands | A | 22 | 40 | 880 | Without |
| | | | | | | | | With |
| Ex. 6 | 167T-10F | 0.7 | 6 yarns, 56 strands | A | 16.7 | 60 | 1000 | Without |
| Ex. 7 | 470T-20F | 0.5 | 3 yarns, 56 strands | A | 23.5 | 60 | 1410 | Without |
| Ex. 8 | 550T-25F | 0.5 | 2 yarns, 32 strands | A | 22 | 50 | 1100 | Without |
| Ex. 9 | 550T-25F | 0.5 | 2 yarns, 64 strands | A | 22 | 50 | 1100 | Without |
| C. Ex 1 | 220T-10F | 0.8 | 2 yarns, 56 strands | A | 22 | 20 | 440 | Without |
| | | | | | | | | With |
| C. Ex. 2 | 500T- 20F | 0.4 | 1 yarns, 56 strands | A | 25 | 20 | 500 | Without |
| C. Ex. 3 | 167T-10F | 0.7 | 4 yarns, 56 strands | A | 16.7 | 40 | 670 | Without |
| | | | | | | | | With |
| C. Ex. 4 | Monofilament: 0.25 mm | 0.3 | 1 yarns, 56 strands | A | 658 | 1 | 658 | Without |
| | Multifilament: 440T-100F | 1.2 | 2 yarns, 56 strands | | 4.4 | 200 | 880 | With |
| C. Ex. 5 | 440T-12F | 0.4 | 2 yarns, 56 strands | A | 36 | 24 | 880 | Without |

TABLE 2

| | | Sleeve Characteristics | | | | | | | |
|---|---|---|---|---|---|---|---|---|---|
| | Braiding With or Without Washing | Inner Diameter (mm) | Thickness (mm) | Number of Braided Stitches (stitches/inch) | Weight (g/m) | Partial Discharge Characteristics (V) | Cylindrical Shape Retentive Properties | Covering Properties | Oil Resistance at High Temperatures |
| Ex 1 | Without | 7.0 | 0.43 | 31.1 | 8.3 | 1950 | A | A | 91 |
| | With | 7.0 | 0.43 | 31.1 | 8.3 | 2150 | A | A | 91 |
| Ex 2 | Without | 7.0 | 0.39 | 31.1 | 7.2 | 1840 | A | A | 91 |
| Ex 3 | Without | 7.1 | 0.41 | 30.9 | 7.6 | 2000 | A | A | 90 |
| Ex 4 | Without | 7.2 | 0.45 | 29.8 | 9.1 | 2050 | A | A | 90 |
| Ex 5 | Without | 6.7 | 0.40 | 35.5 | 7.7 | 1750 | A | A | 90 |
| | With | 6.7 | 0.40 | 35.5 | 7.7 | 1950 | A | A | 90 |
| Ex 6 | Without | 6.8 | 0.42 | 31.0 | 8.1 | 1800 | A | A | 90 |
| Ex 7 | Without | 7.2 | 0.48 | 29.0 | 9.3 | 2050 | A | A | 89 |
| Ex 8 | Without | 4.1 | 0.43 | 26.6 | 5.0 | 1900 | A | A | 90 |
| Ex 9 | Without | 7.8 | 0.43 | 28.1 | 10.3 | 1880 | A | A | 90 |
| C. Ex 1 | Without | 6.5 | 0.28 | 47.0 | 4.3 | 1350 | A | A | 91 |
| | With | 6.5 | 0.28 | 47.0 | 4.3 | 1600 | A | A | 91 |
| C. Ex 2 | Without | 6.5 | 0.29 | 46.4 | 4.9 | 1500 | A | A | 91 |
| C. Ex 3 | Without | 6.7 | 0.33 | 32.0 | 5.4 | 1040 | B | A | 90 |
| | With | 6.7 | 0.33 | 32.0 | 5.4 | 1400 | B | A | 90 |
| C. Ex 4 | Without | 6.6 | 0.50 | 15.7 | 6.7 | 1000 | A | B | 90 |
| | With | 6.6 | 0.50 | 15.7 | 6.7 | 1300 | A | B | 89 |
| C. Ex 5 | Without | 6.7 | 0.58 | 31.0 | 7.7 | 1400 | A | B | 90 |

As is obvious from Tables 1 and 2, it was confirmed that Examples 1 to 7 had high partial discharge characteristics (electrical insulation performance) and also had good electrical insulation properties even when a step of washing away the raw yarn oil solution applied to the filaments was omitted, good cylindrical shape retentive properties, and high covering properties and oil resistance at high temperatures.

On the other hand, in Comparative Examples 1 to 3, since the yarn total fineness of a single braid unit of the braided cord was less than 800 dtex, the covering properties were good but the thickness was not sufficient, which resulted in insufficient partial discharge characteristics. Furthermore, in Comparative Example 4, since monofilaments with a high fineness were used, the number of braided stitches was not able to be increased and thereby they were not able to be braided with the fibers being spread uniformly. Thus voids were observed in the vicinity of intersections of the monofilaments, and the covering properties and the partial discharge characteristics were insufficient. Moreover, in Comparative Example 5, since the single-yarn fineness was high, the thickness was too high, which resulted in insufficient covering properties and partial discharge characteristics.

Example 8 and Example 9

Two raw yarns (5507-25F) used in Example 4 were doubled and sleeves were braided with 32 strands (Example 8; an inner diameter of around 4 mm) and 64 strands (Example 9; an inner diameter of approximately 8 mm). After braided, they were heat-treated at 190° C. for 0.5 minute with a non-contact heater having a cylindrical shape as shown in FIG. 4. The results were indicated in Table 1 and 2. Both of them had good properties as protective sleeves.

Comparative Example 6

The same raw yarns as those used in Example 1 were braided in the same manner except that they were not air interlaced. However, the yarns had poor bundling properties (coherence) and were napped or broken. Thus, stable braiding was difficult.

INDUSTRIAL APPLICABILITY

The protective sleeve for a motor component of the present invention is suitable for not only a motor for a vehicle but also a motor for an electrical home appliance such as an air-conditioner or a refrigerator and a power motor.

DESCRIPTION OF NUMBERS

1 Synthetic Fiber Multifilament Feeding Yarn
2 Opened Part
3 Bundled Part
4 Interlaced Yarn
5 Fluid Interlacer
6 Pressure Air
11, 12, 21, 22 Multifilament Braiding Yarns
23, 24 Monofilament Braiding Yarns
25 Opening (Void)
30 Equipment for Manufacturing Braided Sleeve
31, 32 Platforms
33 Bobbin
34 Yarn
35 Lifting Part
36 Head
37 Cylindrical Part
38, 40 Braided Sleeve
39 Heater
41, 42 Drawing Guides (Pulleys)
43 Container

The invention claimed is:

1. A protective sleeve for a motor component, obtained by braiding multifilament yarns made of synthetic fibers into a cylindrical braided cord of at least 24 strands, wherein the multifilament yarns have a single-yarn fineness of at least 15 dtex but less than 30 dtex, and the yarn total fineness of a single braid unit of the braided cord is in a range of 800 to 1500 dtex, and the multifilament yarns to be supplied for the braided cord have been interlaced, and the protective sleeve has a partial discharge inception voltage of at least 1700 V after the multifilament yarns are braided into the braided cord.

2. The protective sleeve for a motor component according to claim 1, wherein in the multifilament yarns that have been interlaced, interlaced parts thereof come loose when they are braided into the braided cord and thereby constituent yarns of the sleeve are flattened.

3. The protective sleeve for a motor component according to claim 1, wherein the protective sleeve has a partial discharge inception voltage of at least 1750 V.

4. The protective sleeve for a motor component according to claim 1, wherein the sleeve has a wall thickness in a range of 0.35 to 0.55 mm.

5. The protective sleeve for a motor component according to claim 1, wherein the sleeve has an oil resistance at high temperatures of at least 70%.

6. The protective sleeve for a motor component according to claim 1, wherein the synthetic fibers are polyphenylene sulfide fibers.

7. The protective sleeve for a motor component according to claim 1, wherein the amount of oil contained in the multifilament yarns is 0.3 to 2.0 wt % and the partial discharge inception voltage is at least 1700 V.

8. The protective sleeve for a motor component according to claim 1, wherein when a side surface of the protective sleeve is observed with a light microscope at 50 times power, the number of voids, through which the inside of the sleeve can be seen and each of which is observed between a braiding yarn and a braiding yarn, is 0 to 0.5 per 100 square millimeters.

9. The protective sleeve for a motor component according to claim 1, wherein the number of braided stitches of the protective sleeve is 23 to 40 stitches/25.4 mm.

10. The protective sleeve for a motor component according to claim 1, wherein the weight per unit length of the protective sleeve is 4 to 12 g/m.

11. The protective sleeve for a motor component according to claim 1, wherein the protective sleeve has an inner diameter of 3 to 8 mm.

12. A method for manufacturing a protective sleeve for a motor component according to claim 1, wherein a cylindrical sleeve is obtained by braiding multifilament yarns, with an at least 24-strand braiding machine, along an outer periphery of a circular or polygonal round rod with a tip whose size is substantially equivalent to the inner diameter of a braided cord, with a lift head being moved vertically up and down from the bottom of the center, using the multifilament yarns that have a single-yarn fineness of at least 15 dtex but less than 30 dtex and have been interlaced by air interlacing, with a yarn total fineness of a spool-wound single braid unit being 800 to 1500 dtex.

* * * * *